US009249566B2

(12) United States Patent
Eggleston, II et al.

(10) Patent No.: US 9,249,566 B2
(45) Date of Patent: Feb. 2, 2016

(54) STACKABLE TOWER SHAFT WALL STAIR UNIT AND METHOD

(71) Applicants: Richard John Eggleston, II, Asotin, WA (US); Guy Conversano, Bellevue, WA (US)

(72) Inventors: Richard John Eggleston, II, Asotin, WA (US); Guy Conversano, Bellevue, WA (US)

( * ) Notice: Subject to any disclaimer, the term of this patent is extended or adjusted under 35 U.S.C. 154(b) by 0 days.

(21) Appl. No.: 14/656,105

(22) Filed: Mar. 12, 2015

(65) Prior Publication Data

US 2015/0233108 A1 Aug. 20, 2015

Related U.S. Application Data

(60) Provisional application No. 61/970,742, filed on Mar. 26, 2014.

(51) Int. Cl.

| | |
|---|---|
| ***E04B 1/34*** | (2006.01) |
| ***E04H 12/34*** | (2006.01) |
| ***E04B 1/348*** | (2006.01) |
| ***E04B 1/16*** | (2006.01) |
| ***E04F 11/02*** | (2006.01) |

(52) U.S. Cl.

CPC ..... *E04B 1/34823* (2013.01); *E04B 1/16* (2013.01); *E04B 1/34861* (2013.01); *E04F 11/02* (2013.01); *E04H 12/342* (2013.01); *E04B 2103/02* (2013.01)

(58) Field of Classification Search

CPC ..... E04F 11/025; E04F 11/02; E04F 11/022; E04F 11/116; E04F 2011/0212; E04H 1/04; E04H 4/144; E04B 1/34; E04B 2/18

USPC ..... 52/79.1, 79.7, 79.11–79.14, 185, 186, 52/189, 190

See application file for complete search history.

(56) References Cited

U.S. PATENT DOCUMENTS

| | | | | | |
|---|---|---|---|---|---|
| 2,241,169 | A | * | 5/1941 | Yokes | 52/223.7 |
| 3,220,141 | A | * | 11/1965 | Goss, III | 446/124 |
| 3,678,637 | A | * | 7/1972 | Klipfel | 52/79.3 |
| 3,755,974 | A | * | 9/1973 | Berman | 52/73 |
| 3,768,016 | A | * | 10/1973 | Townsend et al. | 455/25 |
| 3,800,493 | A | * | 4/1974 | Livingston | 52/745.03 |
| 3,830,026 | A | * | 8/1974 | Tylius | 52/185 |
| 3,882,649 | A | * | 5/1975 | Mah et al. | 52/79.9 |
| 3,991,528 | A | * | 11/1976 | Dillon | 52/79.9 |
| 4,248,020 | A | * | 2/1981 | Zielinski et al. | 52/185 |
| 4,364,206 | A | * | 12/1982 | Wybauw | 52/79.7 |
| 4,565,043 | A | * | 1/1986 | Mazzarese | 52/592.6 |
| 4,930,273 | A | * | 6/1990 | Papesch | 52/79.1 |
| 5,203,707 | A | * | 4/1993 | Musto et al. | 434/226 |
| 5,484,236 | A | * | 1/1996 | Gravier | 405/286 |

(Continued)

*Primary Examiner* — Elizabeth A Plummer
*Assistant Examiner* — Kyle Walraed-Sullivan
(74) *Attorney, Agent, or Firm* — Randall Danskin, P.S.

(57) ABSTRACT

A precast stackable tower shaft wall stair unit and method having four structurally interconnected opposing walls forming a peripherally defined body defining a medial channel extending therethrough. A locking recess is defined in one corner portion at adjacent interconnected walls, and a mating locking protuberance is carried at a diametrically and vertically opposite corner portion allowing units to be stacked upon one another forming a continuous medial channel extending therethrough. A lower landing, an upper landing and a flight of stairs extending between a lower landing and an upper landing are carried on a wall in the medial channel extending from the lower edge to an upper edge. Stacking of adjacent to units simultaneously forms a medial channel extending therethrough and a continuous stairway therein.

3 Claims, 10 Drawing Sheets

(56) References Cited

U.S. PATENT DOCUMENTS

| | | | | | |
|---|---|---|---|---|---|
| 5,575,119 | A * | 11/1996 | Wolfowitz | ..... | 52/79.1 |
| 5,623,797 | A * | 4/1997 | Gravier et al. | ..... | 52/284 |
| 5,625,998 | A * | 5/1997 | Madsen | ..... | 52/745.03 |
| 6,826,879 | B1 * | 12/2004 | Allen et al. | ..... | 52/236.3 |
| D566,298 | S * | 4/2008 | Bornhorst et al. | ..... | D25/63 |
| 2005/0066589 | A1 * | 3/2005 | Bedell et al. | ..... | 52/79.1 |
| 2008/0134616 | A1 * | 6/2008 | Craven et al. | ..... | 52/606 |
| 2009/0249714 | A1 * | 10/2009 | Combs et al. | ..... | 52/190 |
| 2011/0016800 | A1 * | 1/2011 | Rutledge | ..... | 52/79.1 |
| 2011/0296769 | A1 * | 12/2011 | Collins et al. | ..... | 52/79.1 |
| 2012/0110928 | A1 * | 5/2012 | Liberman | ..... | 52/122.1 |

* cited by examiner

STACKABLE TOWER SHAFT WALL STAIR UNIT AND METHOD

RELATED APPLICATIONS

This utility patent application claims the benefit of earlier filed U.S. Provisional Patent Application No. 61/970,742 titled STACKABLE TOWER SHAFT WALL STAIR UNIT AND METHOD filed on Mar. 26, 2014. The entire contents of earlier filed U.S. Provisional Patent Application No. 61/970,742 is expressly incorporated herein by this reference.

BACKGROUND OF INVENTION

1. Field of Invention

The present invention relates to towers, shafts and stairways. More particularly, the present invention relates to precast stackable concrete bodies, each precast body having four structurally interconnected walls defining a medial channel extending therethrough, the precast bodies are stackable vertically to provide a tower and/or shaft having a continuous medial channel extending therethrough and a continuous flight of stairs extending through the medial channel of the tower and/or shaft.

2. Background

Many construction projects including, but not limited, to mining, pumping stations, cooling towers, underwater construction, underground geothermal installations, and above ground access chambers whether of new construction or retro-fit/remodeling have a need for vertical shafts for elevators, stairs and/or service equipment such as communication, plumbing and electrical. Regulations and building codes for such shaft structures are replete with requirements for safety, access, and ingress and egress redundancy.

It is known in the construction industry for shafts and towers to be either "cast in place" or formed using "precast planar wall panels" that are attached to one another "in-situ" to form the shaft.

Generally, towers and shafts for elevators, stairs, service equipment, and the like are formed by establishing a supporting foundation at the lowest level, and then constructing the shaft/tower vertically upwardly from the foundation which may be at ground level, below ground level or above ground level. For purposes of this disclosure, the method is described for constructing a shaft below grade (i.e. below ground level) but the process for constructing a tower (above grade) is similar except that the components are hoisted vertically upwardly to be placed upon an uppermost level as opposed to lowered into a shaft to connect with a previously positioned level.

When the "cast in place" method is used, a shaft is excavated in the ground and movable, spaced apart forms are positioned to form an inside surface of a shaft/tower wall and at a position to form an outside/exterior surface of the shaft/tower wall. Reinforcing elements such as steel, and/or rebar may be added to the space between the two forms and concrete is then poured into the space defined between the forms and about the reinforcing elements. As the concrete at the lowest levels cures/hardens, the forms are moved and repositioned upwardly and more reinforcing is added and more concrete is poured. The process is repeated/continued until the desired uppermost level is formed. This "cast in place" method is complex, dangerous and time consuming, especially when a below grade shaft is being formed because a shaft requires workers to be within the shaft to position and move the forms, install the reinforcing, pour the concrete, and all of the construction materials must be lowered down the shaft from above while the workers are within the shaft. After the shaft/tower is complete, stairs may be added to interior shaft walls by attaching fastening means to the interior shaft walls and thereafter attaching stringers/flights of stairs to the fastening means after lowering the stringers/flights of stairs down the shaft from above.

When the pre-cast planar wall panel method/process is used to construct a below grade shaft, the pre-cast planar wall panels are hoisted with a crane and lowered into the shaft and positioned one at a time upon a foundation and fastened thereto. Thereafter, additional pre-cast planar wall panels are fastened to the previously installed pre-cast wall panels along adjacent edge portions. This method is also complex, dangerous and time consuming because it requires workers to be within the shaft to position and align the pre-cast planar wall panels, to support the pre-cast wall panels while the level is completed, to interconnect the panels together, to caulk or otherwise seal the joints between the adjacent panels and all of the construction materials must be lowered down the shaft from above while the workers are within the shaft. Each of the pre-cast planar wall panels generally carries at least one weld-plate at each end portion and at top and bottom portions that are positioned immediately adjacent similar weld-plates carried by immediately adjacent pre-cast wall panels when the wall panel is properly positioned. The weld-plates are "welded" together to provide additional strength and integrity between the adjacent wall panels. Unfortunately the welding of weld plates may require workers to access both the interior and exterior portions of the pre-cast planar panels within the shaft. The weld plates also add complexity to the pre-casting of the planar wall panels as the weld plates must be correctly positioned within the forms prior to the concrete being poured into the forms, and the "bonding" of metal to concrete can be problematic as such interfaces are subject to corrosion, chemical reactions and the like that can, over time, weaken the concrete proximate to the metal weld plate and/or weaken the metal comprising the weld plate and/or weaken the weld interconnecting the adjacent weld plates.

Such known methods for forming towers and shafts are complex, dangerous to workers, expensive and time consuming. In the situations where a shaft is being constructed below grade, "shoring" and support must be installed and maintained throughout the length of the shaft for the duration of the project to prevent collapse of the surrounding earth defining the shaft. There may also be a need for a temporary elevator or lift for workers to reach the work site inside the shaft such as to move the forms and weld the weld-plates to one another. After the shaft is complete, workers must seal/caulk the joints between the adjacent panels and install flights of stairs within the shaft by attaching fasteners to inside walls of the shaft at specified locations, and thereafter attaching stringers of stairs to the fasteners which are lowered down the shaft from above. This work is hazardous as the flights of stairs must be lowered down the shaft from above while the workers are within the shaft. Further yet, when the shaft to be constructed is below grade level, the "hole" in which the shaft is constructed needs to be significantly larger than the ultimate finished shaft size because of the need for workers to readily and safely access the exterior of the forms while the shaft wall is being built.

The instant invention overcomes various of the aforementioned drawbacks to known construction methods and apparatus for towers and shafts by providing a precast stackable peripherally defined unit having four structurally interconnected spaced apart tower/shaft walls defining a medial channel extending therethrough. Each stackable unit may carry a preinstalled flight of stairs within the channel defined by the walls. A locking protrusion and a locking recess defined in diametrically and vertically opposing top and bottom corners of each unit allows units to be stacked on top of one another providing a continuing staircase within the medial channel. Because each unit is integral, having four interconnected cooperating supporting walls the thickness of the walls may be reduced while maintaining necessary strength and rigidity and reducing weight. Further, because the four walls are formed as a single unit there are no vertical seams that need to be caulked or otherwise sealed because as each unit is stacked in place that level is complete and useable by workers. Because each unit is similar, the concrete forms for casting the units are all the same. Horizontal seams between immediately adjacent units carry a pre-installed pliable sealant such as, but not limited to butyl tape which provides a fluid tight seal between immediately adjacent units. Weight of the stacked units compresses the pliable sealant which may be applied to an upper and/or lower surface edge of each unit prior to installation further reducing labor costs and time.

Further still, because there is only a limited need for workers to physically access and work on the exterior surface portions of the units during installation, the shaft may be smaller further reducing time and associated costs. Because the flights of stairs may be preinstalled within the units as the units are stacked upon one another the stairway is also simultaneously constructed, eliminating the need for subsequent stair installation which even further reduces costs and installation time.

Some or all of the problems, difficulties and drawbacks identified above and other problems, difficulties, and drawbacks may be helped or solved by the inventions shown and described herein. The instant invention may also be used to address other problems, difficulties, and drawbacks not set out above or which are only understood or appreciated at a later time. The future may also bring to light currently unknown or unrecognized benefits which may be appreciated, or more fully appreciated, in the future associated with the novel inventions shown and described herein.

BRIEF SUMMARY OF THE INVENTION

A precast stackable tower shaft wall stair unit and method having a unitary body with four spaced apart opposing walls structurally interconnected at adjacent edge portions defining a medial channel extending therethrough. A locking recess is defined in one corner portion at adjacent interconnected walls, and a locking protuberance is carried at a diametrically and vertically opposite corner portion. The locking recess and locking protuberance allow units to be stacked upon one another forming a continuous medial channel extending therethrough. A lower landing, an upper landing and a flight of stairs extending between the lower landing and the upper landing are carried on a wall within the medial channel extending from a lower edge to an upper edge. Vertical stacking of plural units forms a medial channel extending therethrough and a continuous stairway therein.

In providing such a stackable tower shaft wall stair unit and method it is:

a principal object to provide precast stackable tower shaft wall stair units that allow for thinner wall sections.

a further object to provide a precast stackable tower shaft wall stair unit and method that reduces installation time, minimizes onsite welding, and reduces sealing of joints.

a further object to provide a precast stackable tower shaft wall stair unit that is lighter than pre-cast planar panel wall construction.

a further object to provide a precast stackable tower shaft wall stair unit that may use steel stair systems.

a further object to provide a precast stackable tower shaft wall stair unit and method that may be aligned and interconnected by a variety of means including, but not limited to, grout sleeves, weld plates, aligned pegs and holes, adhesives, interlocking recesses and protuberances and keyways.

a further object to provide a precast stackable tower shaft wall stair unit and method for use in mining, pumping stations, cooling towers, underwater construction, underground geothermal installations, and above ground access chambers and multi story buildings.

a further object to provide a precast stackable tower shaft wall stair unit and method that provides superior installation relative to time and cost compared to standard precast and cast-in-place shaft-wall construction methods and apparatus.

a further object to provide a stackable tower shaft wall stair unit and method that may be precast using molds.

a further object to provide a stackable tower shaft wall stair unit that may be precast using forms.

a further object to provide a stackable tower shaft wall stair unit that may be precast off-site and transported to an installation site.

a further object to provide a stackable tower shaft wall stair unit that may be precast on-site to eliminate transportation costs.

a further object to provide a precast stackable tower shaft wall stair unit and method having a preinstalled stairway.

a further object to provide a precast stackable tower shaft wall stair unit and method for new construction.

a further object to provide a precast stackable tower shaft wall stair unit and method for retrofit construction.

a further object to provide a precast stackable tower shaft wall stair unit and method to form elevator shafts.

a further object to provide a precast stackable tower shaft wall stair unit and method for equipment and service shafts.

a still further object to provide a precast stackable tower shaft wall stair unit and method that provides usable stairways for workers as each level is completed.

Other and further objects of the instant invention will appear from the following specification and accompanying drawings which form a part hereof. In carrying out the objects of the invention it is to be understood that its structures and features and steps are susceptible to change in design and arrangement and order with only one preferred and practical embodiment of the best known mode being illustrated in the accompanying drawings and specified as is required.

BRIEF DESCRIPTION OF THE DRAWINGS

Preferred forms, configurations, embodiments and/or diagrams relating to and helping to describe preferred aspects and versions of the instant invention are explained and characterized herein, often with reference to the accompanying drawings. The drawings and features shown herein also serve as part of the disclosure of the invention, whether described in text or merely by graphical disclosure alone. The drawings are briefly described below.

DETAILED WRITTEN DESCRIPTION

Introductory Notes

Figure 1:
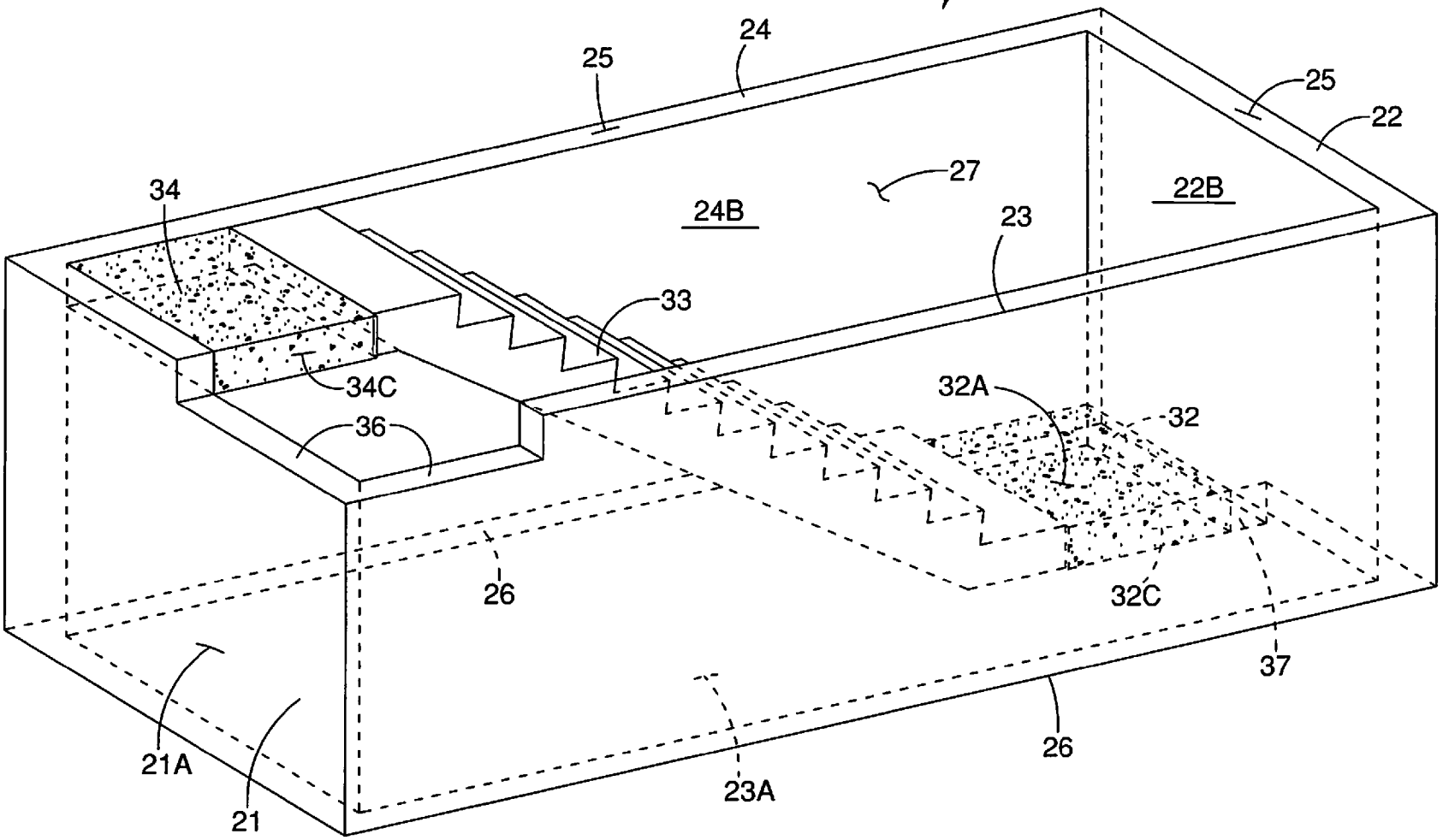
FIG. 1 is an isometric top, first end and first side phantom view of one stackable tower shaft wall stair unit showing the medial channel and the flight of stairs communicating from a lower landing to an upper landing along one interior side of the medial channel, and showing the locking recess defined in the proximate upper corner.

The readers of this document should understand that dictionaries were used in the preparation of this document. Widely known and used in the preparation hereof are *The American Heritage Dictionary of the English Language*, (4th Edition ©2000), *Webster's New International Dictionary*, Unabridged, (Second Edition ©1957), *Webster's Third New International Dictionary* (©1993), *The Oxford English Dictionary* (Second Edition, ©1989), and *The New Century Dictionary* (©2001-2005), all of which are hereby incorporated by this reference for interpretation of terms used herein and to more adequately or aptly describe various features, aspects and concepts shown or otherwise described herein using words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text of both Claims and Abstract are incorporated by this reference into the description entirely.

The readers of this document should further understand that the embodiments described herein may rely on terminology and features used in any section or embodiment shown in this document and other terms readily apparent from the drawings and language common or proper therefore.

As used herein, the term "lower", its derivatives and grammatical equivalents refers to that portion of the instant precast stackable tower shaft wall stair unit and method that is vertically proximate a foundation of a structure. It is expressly contemplated herein the foundation may be below ground surface level. The term "upper" its derivatives and grammatical equivalents refers to that portion of the instant precast stackable tower shaft wall stair unit and method that is vertically distal from the foundation.

A stackable tower shaft wall stair unit generally provides a body 20 preferably formed of precast concrete. The body 20 has a first end portion 21, an opposing second end portion 22, a first side 23, an opposing second side 24, a top edge 25 a bottom edge 26 and defines a medial channel 27 extending therethrough from the top edge 25 to the bottom edge 26. The first end portion 21, the second end portion 22, the first side 23 and the second side 24 each have an exterior surface designated by the letter "A" and an opposing interior surface designated by the letter "B".

A locking recess 36 (FIGS. 1 and 5) is defined in the top edge 25 at the intersection of the first end 21 and the first side 23.

Figure 2:
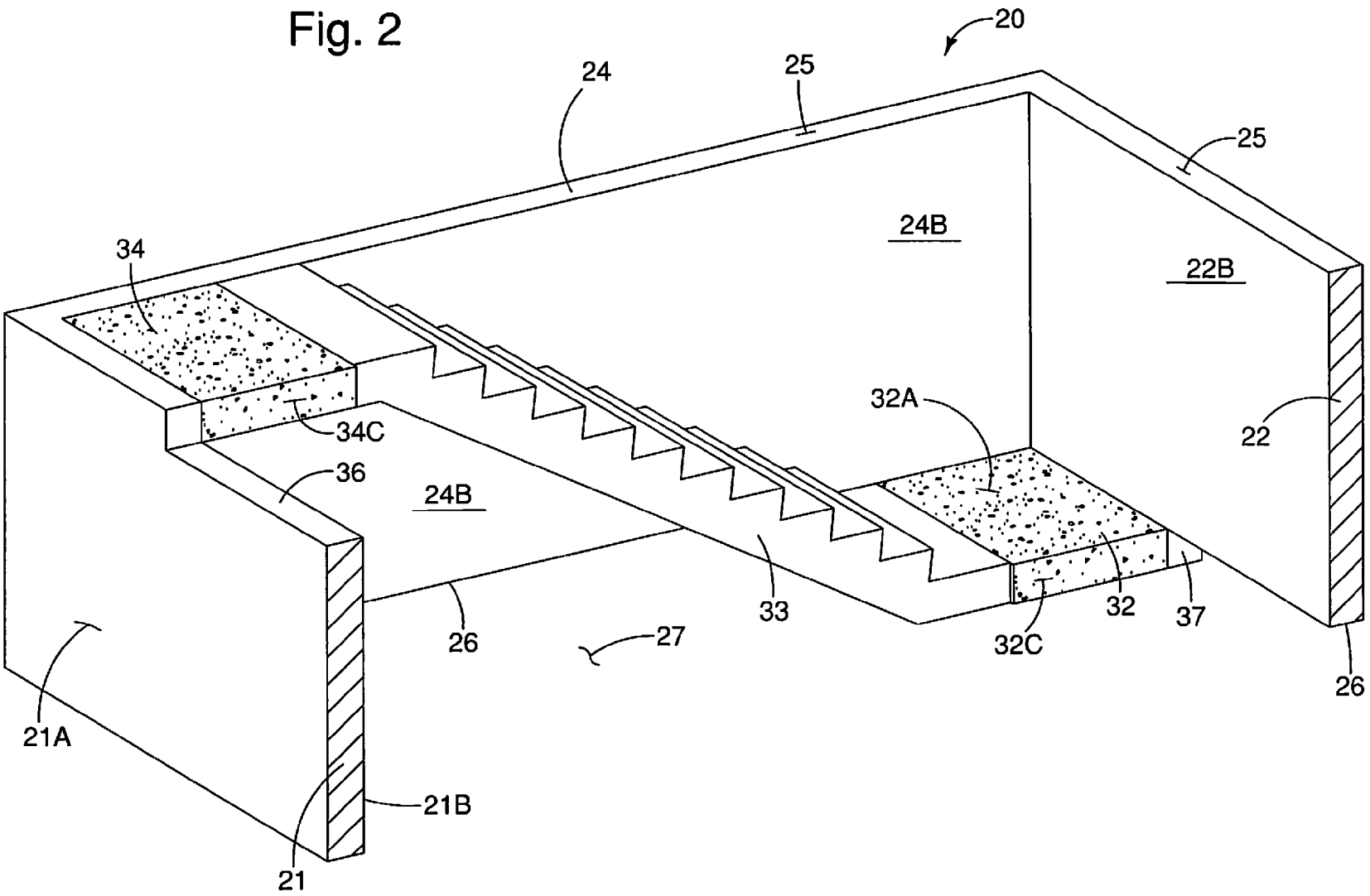
FIG. 2 is an isometric partial cut-away top, first end and first side view, similar to that of FIG. 1 with the first side removed for clarity to show the locking protrusion and at a bottom rearward corner between the second end and the second side.
Figure 3:
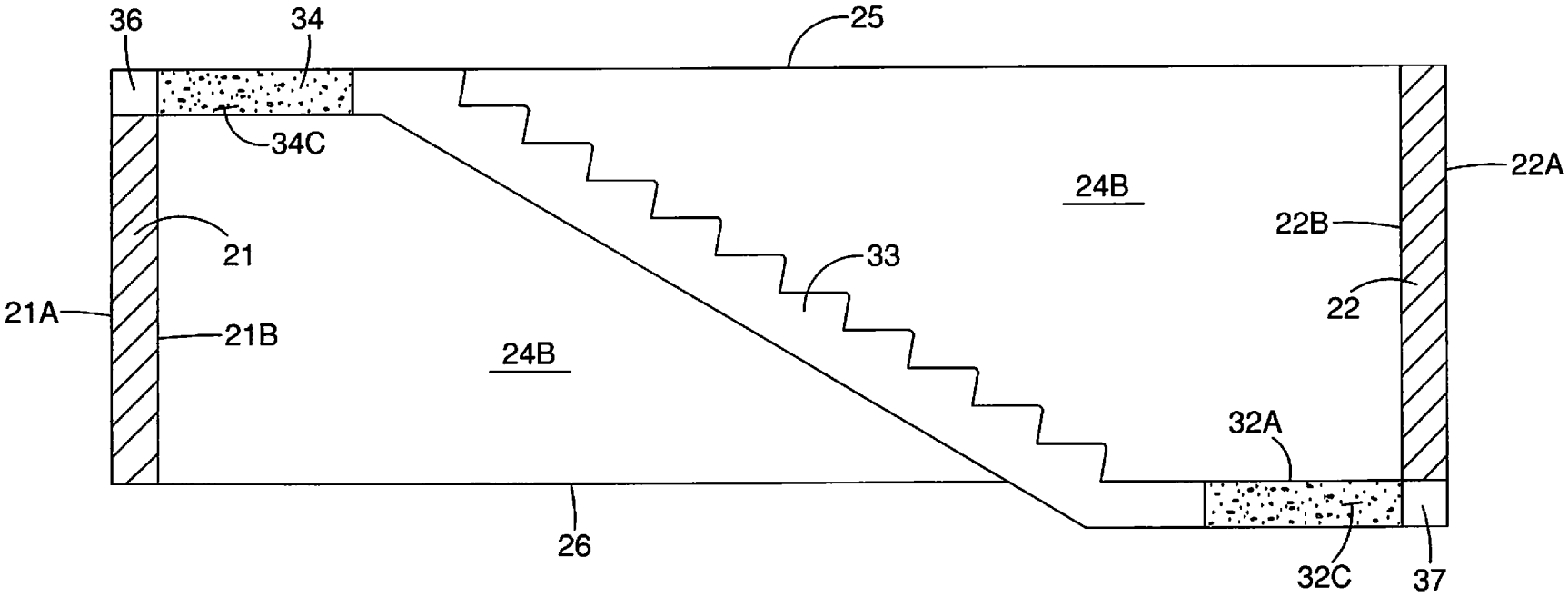
FIG. 3 is an orthographic side view of the tower shaft wall stair unit of FIG. 2.
Figure 4:
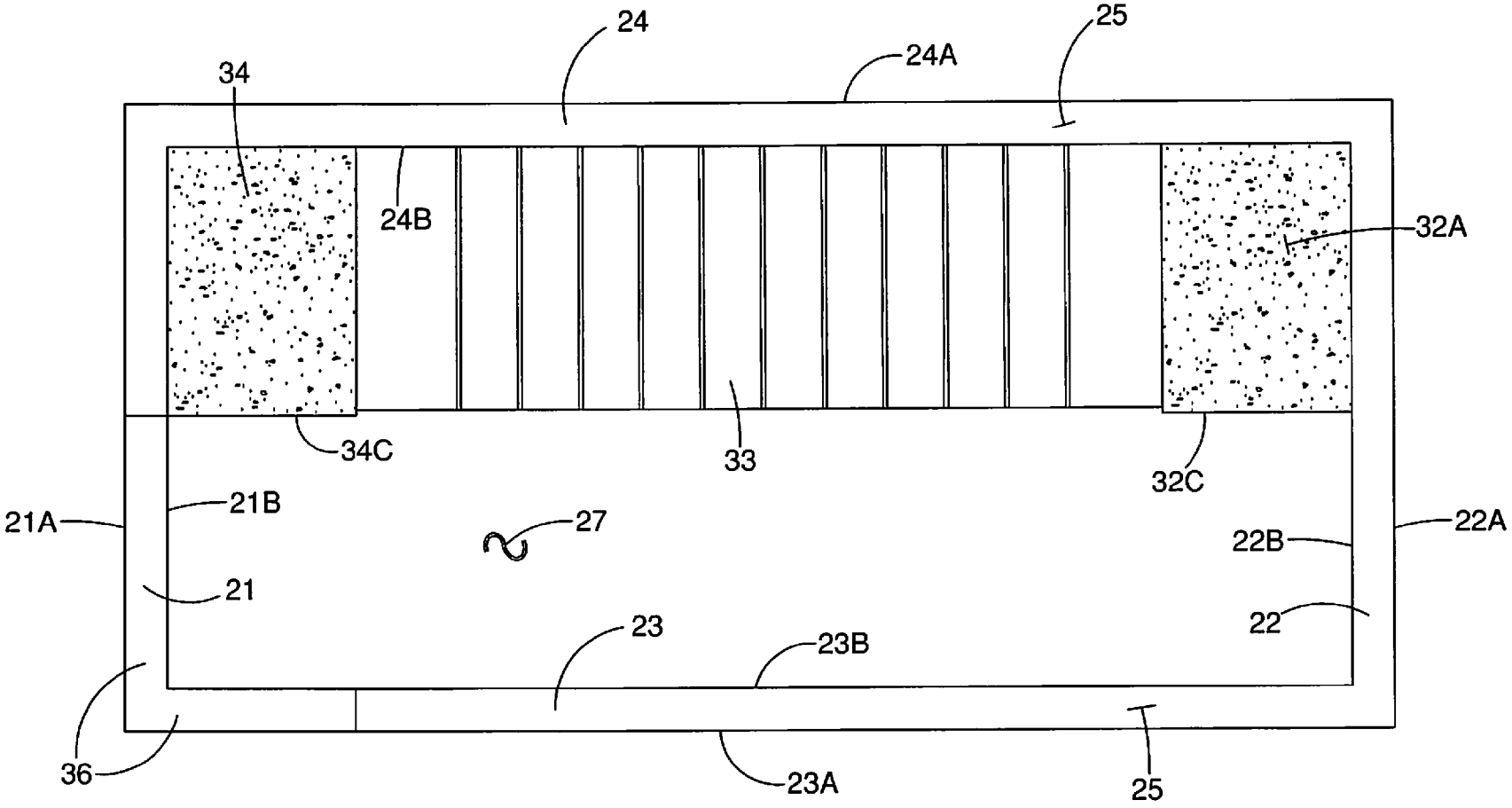
FIG. 4 is a plan view of the tower shaft wall stair unit of FIG. 1.

A locking protuberance 37 (FIGS. 2 and 5) is carried at the bottom edge 26 at the intersection of the second end 22 and the second side 24 which is diametrically and vertically opposite the locking recess 36 defined in the top edge 25. The locking protuberance 37 extends generally perpendicularly from the bottom edge 26. Plural bodies 20 are interconnected during stacking thereof by rotating the vertically upper body 20 180° relative to the lower vertically adjacent body 20.

Dimensions and configurations of the locking protuberance 37 and the locking recess 36 are similar so that the locking protuberance 37 of one body 20 securely engages within the locking recess 36 of a second body when the bodies 20 are stacked. (FIGS. 5, 6, 9 and 10). Although the Figures show the bodies 20 as each having a generally rectangular configuration with the first and second sides 23, 24 being longer than the first and second ends 21, 22 it is expressly contemplated the sides 23, 24 may be equal in length to the ends 21, 22 to form a square configuration and the sides 23, 24 may be shorter than the ends 21, 22.

In the preferred embodiment, (FIG. 2) an upper landing 34 is carried within the medial channel 27 immediately adjacent corner intersection of the first end 21 and the second side 24 opposite locking recess 36. In the preferred embodiment, upper surface 34A of the upper landing 34 is coplanar with the top edge 25 of the body 20. Similarly, a lower landing 32 is carried within the medial channel 27 immediately adjacent corner intersection of the second end 22 and the second side 24 and immediately adjacent the locking protuberance 37. Bottom surface (not shown) of the lower landing 32 is coplanar with bottom portion (not shown) of the corner locking protuberance 37 and to surface 32A of the bottom landing 32 is coplanar with the bottom edge 26. A stringer of stairs 33 comprised of plural structurally interconnected risers and treads extends between the lower landing 32 and the upper landing 34 along the interior surface 24B of the second side 24.

Figure 5:
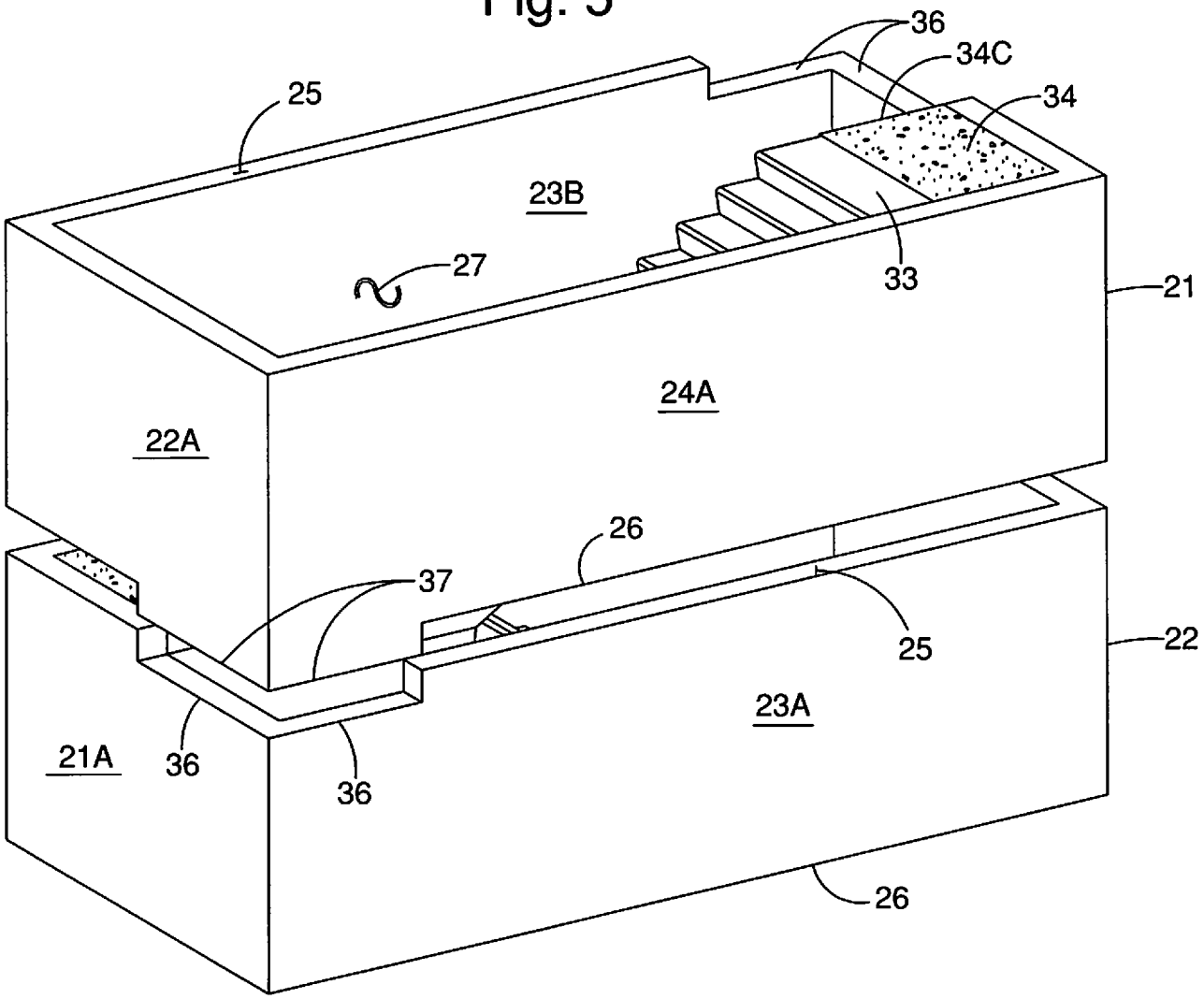
FIG. 5 is an isometric top, end and side view of two tower shaft wall stair units vertically aligned with one another and showing how the locking protuberance engages with the locking recess.
Figure 6:
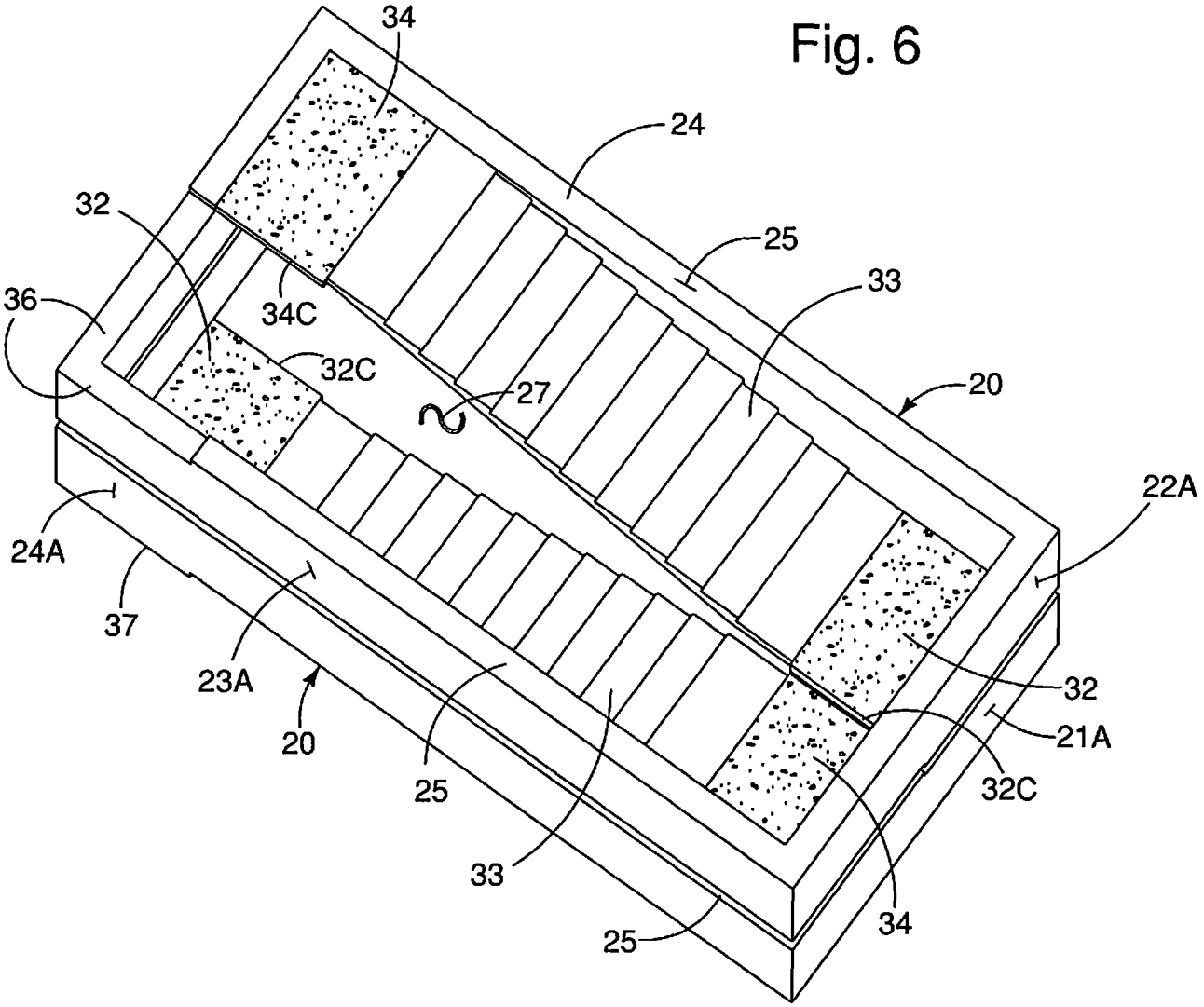
FIG. 6 is an isometric top, end and side, downward looking view of the two vertically aligned tower shaft wall stair units of FIG. 5 (rotated approximately 180 degrees) showing how the flights of stairs cooperatively align within the medial channel when units are stacked.
Figure 7:
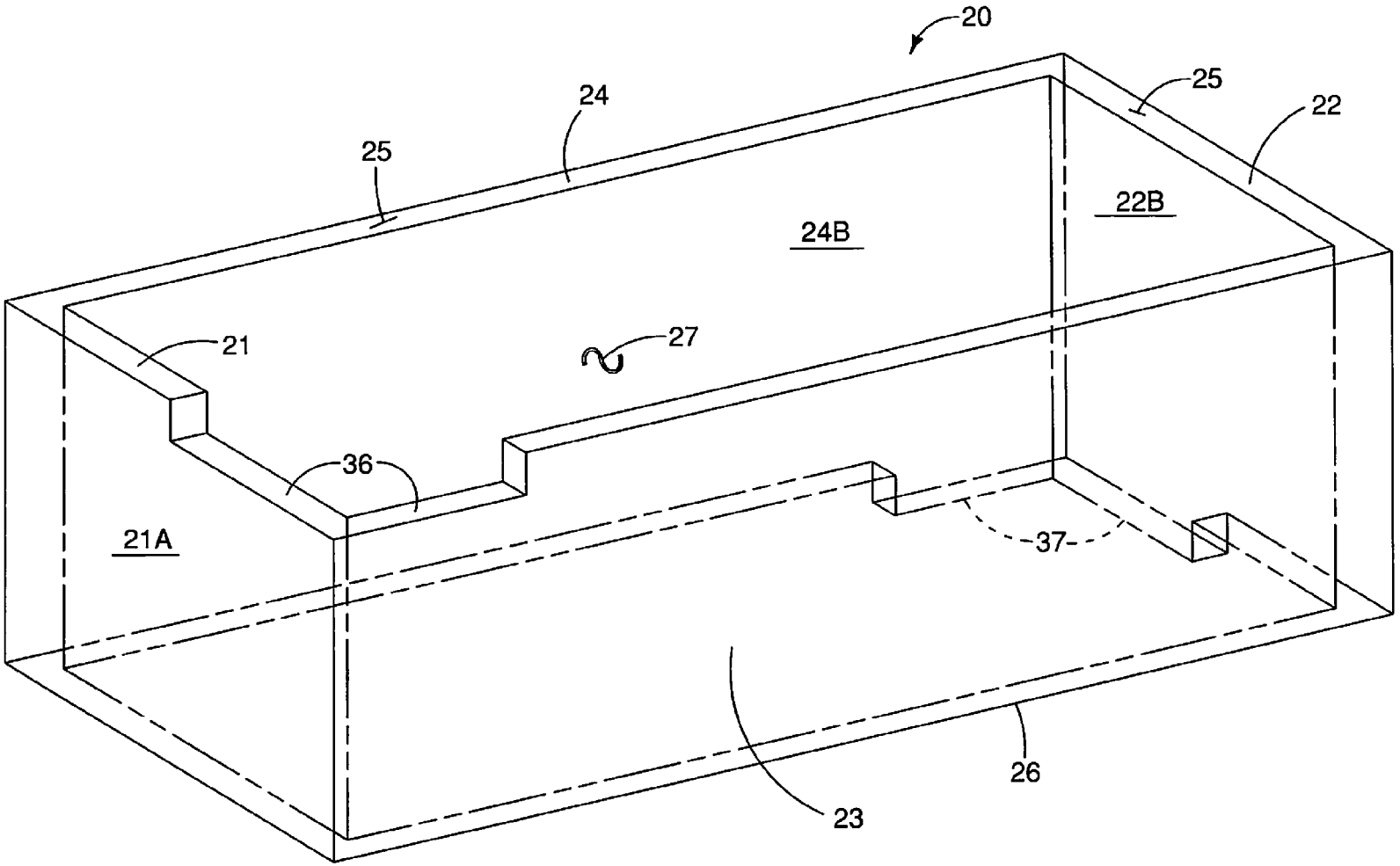
FIG. 7 is an isometric top, first end and first side phantom view of a second embodiment of a stackable tower shaft wall stair unit showing the medial channel without stairs.
Figure 8:
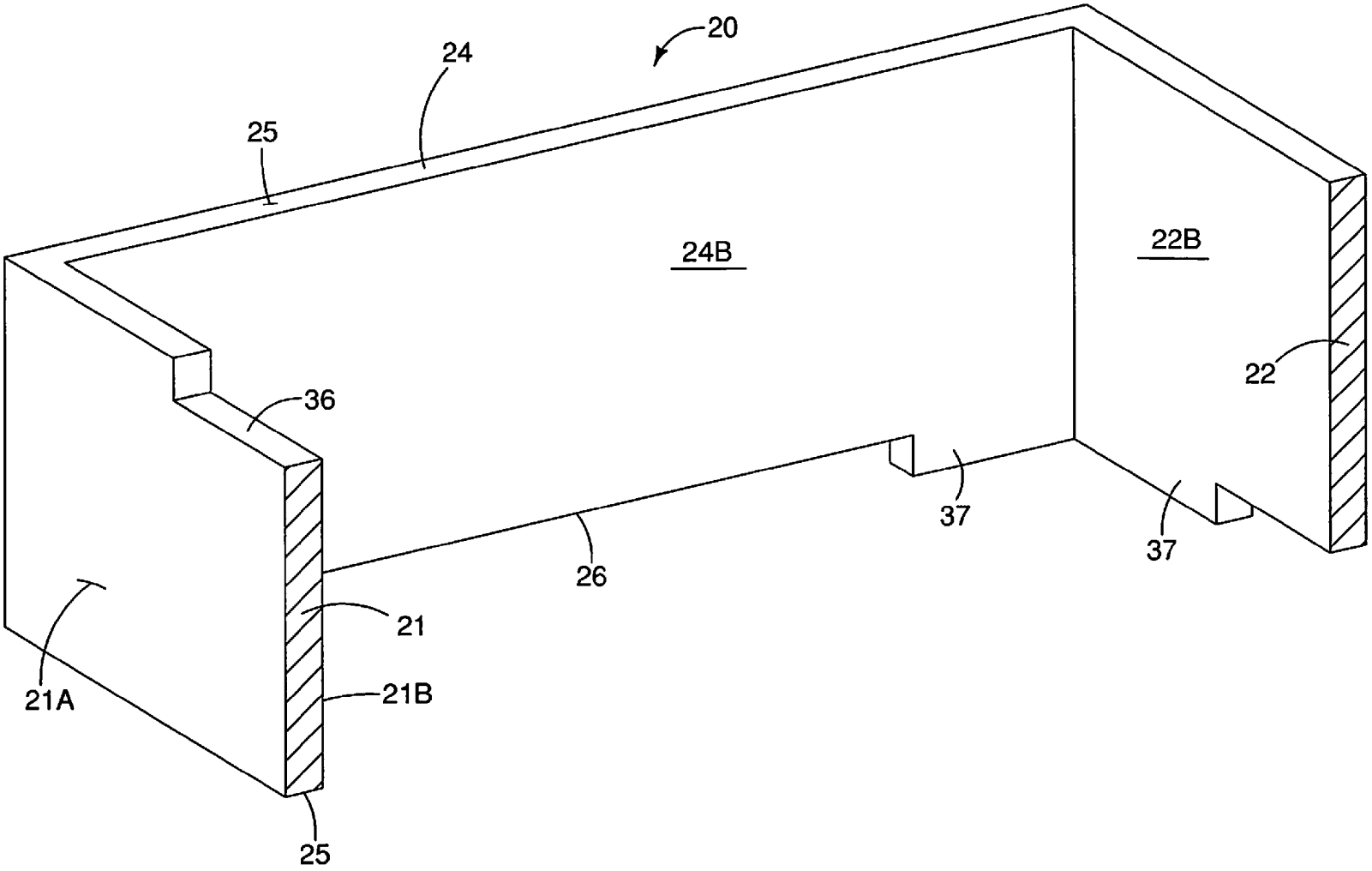
FIG. 8 is an isometric partial cut-away top, first end and first side view similar to that of FIG. 2 showing a second embodiment of the invention without stairs.
Figure 9:
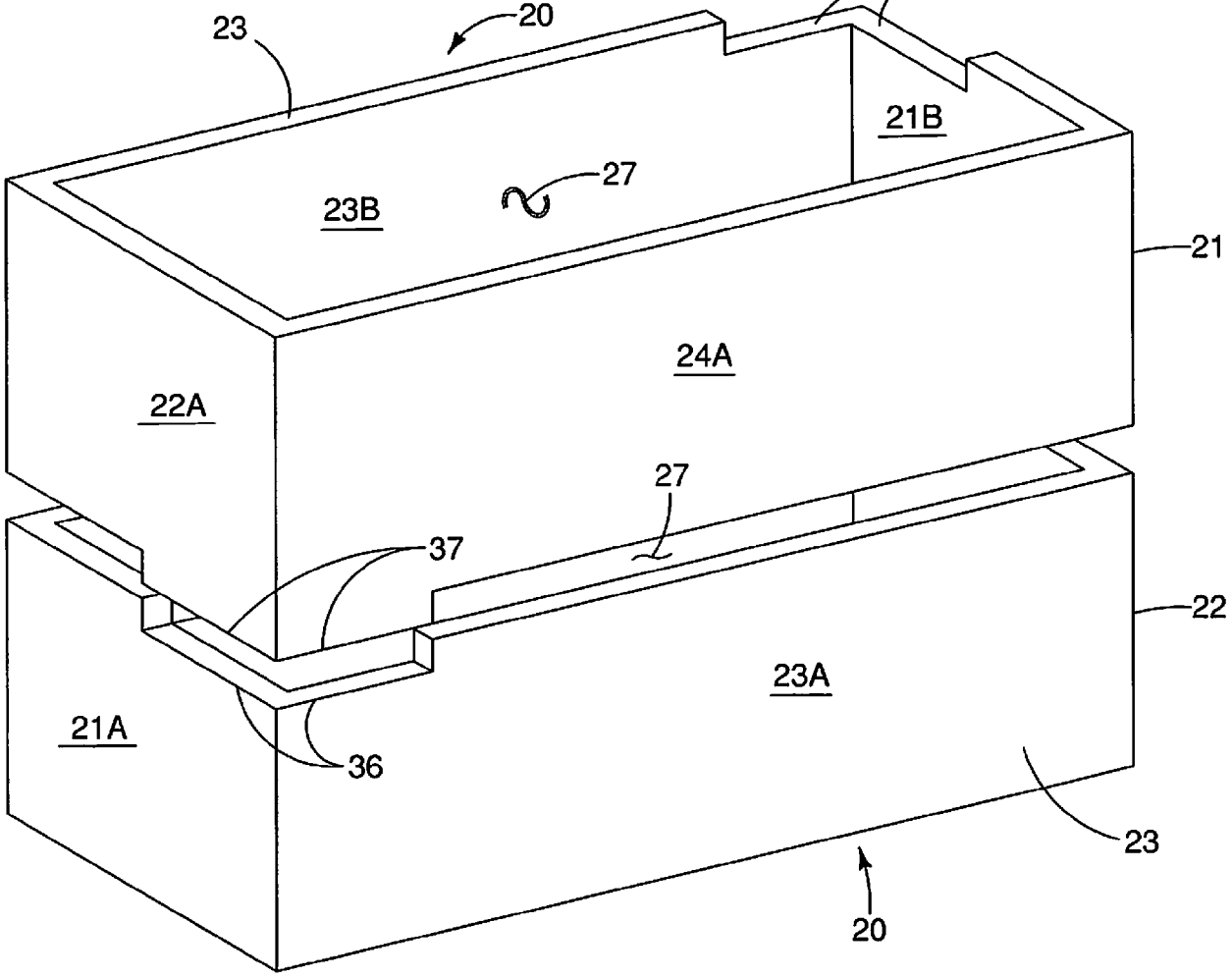
FIG. 9 is an isometric top, end and side view similar to that of FIG. 5 showing the second embodiment with two tower shaft wall stair units vertically aligned showing how the locking protuberance engages with the locking recess.
Figure 10:
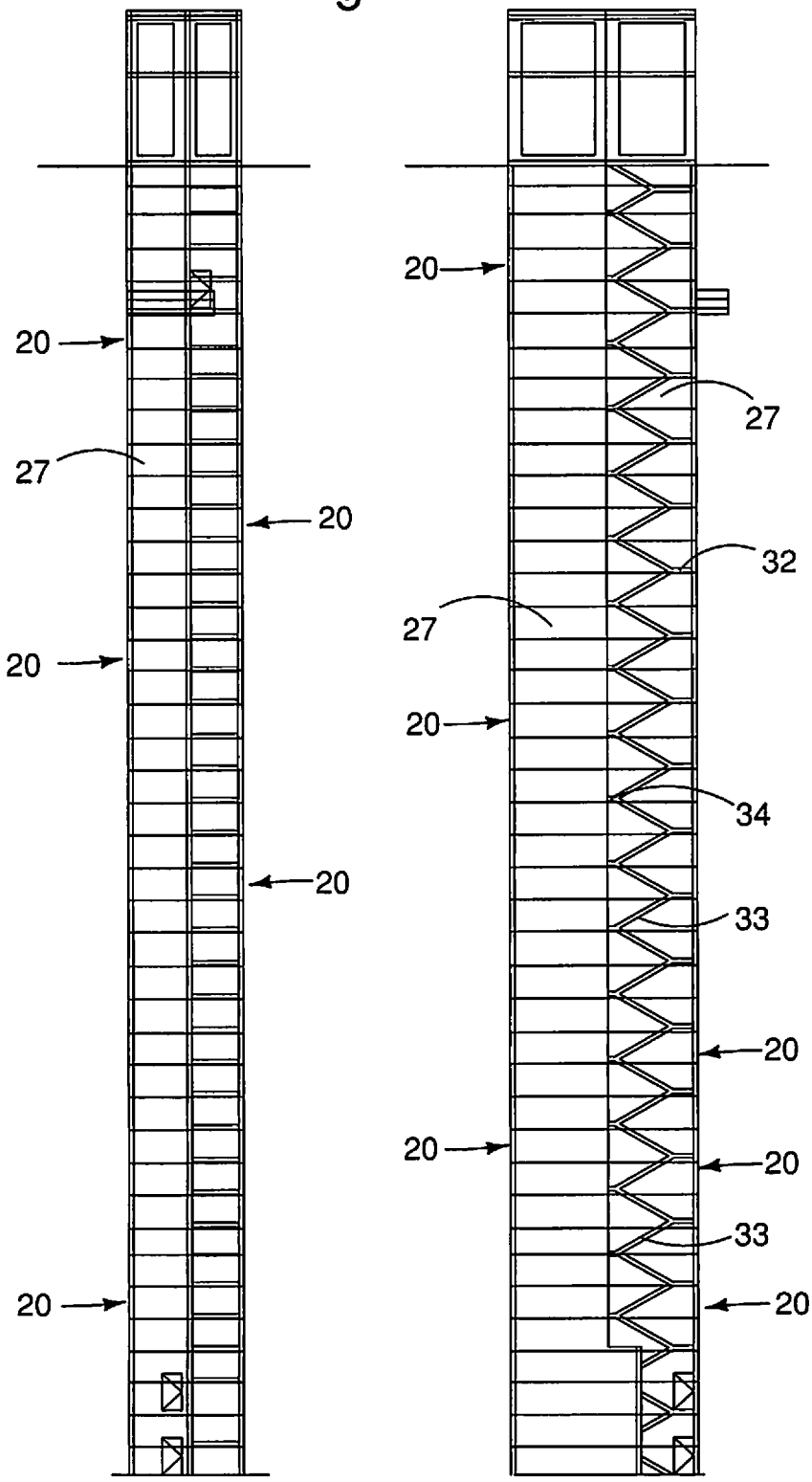
FIG. 10 is an orthographic schematic of plural vertically stacked tower shaft wall stair units defining vertical ground penetrating shafts with an elevator shaft adjacent a stairway shaft.

As shown in FIGS. 5 and 10, plural bodies 20 may be vertically stacked on top of one another so that the medial channel 27 defined by each body 20 communicates with the medial channel 27 of an adjacent the body 20 forming a medial channel 27 extending therethrough. The locking recess 36 and the locking protuberance 37 provide a means for secure locking engagement of vertically adjacent bodies 20. Weld plates (not shown), dowels and aligning holes (not shown), keyways (not shown) and other known alignment means and attachment means may be carried at aligned positions on the top edge 25 and bottom edge 26 of each body 20 to provide additional attachment and alignment of the vertically adjacent bodies 20.

180° rotation of each body 20 relative to the lower vertically adjacent body 20 causes the upper landings 34, the lower landings 32 and the stringers of stairs 33 extending therebetween to form a continuous stairway 33 with opposing landings 32, 34 extending through the medial channel 27. The upper landing 34, and the lower landing 32 align horizontally and vertically when two bodies 20 are interconnected in vertically stacked array. The vertical stacking causes lateral edge portions 32C, 34C of the landings 32, 34 distal from the proximate side wall 24 to be positioned closely proximate one another. (See FIG. 6).

A pliable sealant such as, but not limited to butyl tape (not shown) is applied to the top edge 25 and/or bottom edge 26 of each body 20 extending completely thereabout so that when a vertically adjacent body 20 is engaged therewith, the pliable sealant (not shown) is compressed therebetween providing a seal between the immediately adjacent bodies 20.

As shown in FIG. 10, a plurality of bodies 20 may be vertically stacked upon one another forming a shaft of varying heights with a continuous stairway extending from a bottom level to a top level.

As shown in FIGS. 7-10 in a second preferred embodiment the landings 32, 34 and the stringers of stairs 33 are not included within the medial channel 27 defined by the body 20 providing a uninterrupted vertical shaft (FIG. 10) that may be suitable for installation of an elevator, ventilation ducting and/or service equipment. It is also contemplated that in large installations, plural stacked bodies 20 carrying landings 32, 34 and stringers of stairs 33 may be installed in conjunction with adjacent plural stacked bodies 20 without stairways forming a vertical elevator shaft and a safety stairway proximate thereto for safety and redundancy as required by various codes and regulations. (See FIG. 10).

In the preferred embodiment, the instant stackable tower shaft wall stair unit and the method is described as being used in underground facilities, such as pump stations and mines, but it is contemplated that the instant stackable tower shaft wall stair unit may also be used with a variety of construction projects including new multiple story construction retrofitting of multiple story construction, and even in under water projects such as, but not limited to, dams where dry access to a river bed or lake bed is required.

It is contemplated the bodies 20 may be precast at an off-site facility and transported to a use site for installation. It is also contemplated, that forms and/or molds for casting the bodies 20 may be located on site so that the bodies 20 may be cast on-site (but not cast-in-place), such as in remote mining locations to eliminate transportation costs. It is further contemplated the stringers of stairs 33 may be cast or otherwise formed separately from the body 20 and installed within the medial channel 27 after the body 20 is cast using fluid concrete and associated reinforcing steel. The bodies 20 are precast using forms (not shown) and or molds (not shown) using precast techniques known to those in the art of concrete.

When the body 20 and the stringer of stairs 33 are cast separately and are joined together thereafter, it is envisioned the precast body 20 would be positioned/oriented so that the medial channel 27 and walls 23, 24 and ends 21, 22 all extend vertically. Thereafter the precast stringer of stairs 33 would be positioned within the medial channel 27 adjacent the interior surface 24B of the second side 24 and supported as necessary while concrete forms (not shown) are constructed, braced and supported at opposing end portions of the stringer of stairs 33. The concrete forms (not shown) would communicate between the interior surfaces 21B, 24B of the first end 21 and second side 24 and an upper end portion of the stringer of stairs 33 and also communicate between the interior surfaces 22B, 24B of the second end 22 and the second side 24 and a lower end portion of the stringer of stairs 33. Reinforcing steel (not shown), such as but not limited to rebar would be added to the concrete forms (not shown) to interlink with reinforcing steel (not shown) of the body 20 and with reinforcing steel (not shown) of the stringer of stairs 33. Fluidic concrete would be poured into the concrete forms (not shown) to flow over, about and through the reinforcing steel (not shown) to form the upper landing 34 and the lower landing 32. The concrete within the concrete forms (not shown) would be allowed to harden/cure and thereafter the concrete forms (not shown) and any bracing (not shown) and/or supports (not shown) would be removed. The hardening/curing of the fluidic concrete forming the landings 32, 34 causes the landings 32, 34 and the stinger of stairs 33 to become integral with the body 20 allowing the body 20 with a stringer of stairs 33 within the medial channel 27 to be installed as a single unit. Stair safety railings (not shown) riser edges (not shown) and similar stair appliances may be installed on the stinger of stairs 33 within the medial channel 27.

Plural bodies 20 need be available before installation would begin. A flexible sealant, such as but not limited to butyl tape (not shown) would be applied to the top edge 25 and bottom edge 26 of the bodies 20.

For a below grade installation, it is contemplated a shaft would be excavated using techniques known to those in the art of constructing shafts and that the shaft would be appropriately "shored" to prevent collapse thereof, and that a foundation (not shown) would be constructed at the lowest level or bottom of the shaft. The foundation (not shown) need be sufficiently strong to vertically support the weight of plural vertically stacked bodies 20. After the foundation (not shown) is formed at the lowest level (bottom) of the shaft, a first body 20 would be vertically lowered, by means of a crane or similar lifting apparatus, into the shaft defined in the earth to frictionally rest upon the previously constructed foundation (not shown). After the first body 20 is lowered into the shaft and interconnected with the foundation (not shown), additional bodies 20 are sequentially lowered into the shaft and each body 20 is rotated 180° relative to the immediately lower previously installed body 20 so that the locking protrusion 37 of the body 20 being lowered engages with the locking recess 36 of the previously positioned body 20. The engagement of a body 20 onto the top edge 25 of the adjacent lower body 20 will cause the pliable sealant (not shown) carried on the top edge 25 to be "crushed" and otherwise disbursed along the top edge 25 and bottom edge 26 providing a seal between the immediately adjacent bodies 20. Any weld plates (not shown) dowels and aligned holes (not shown), keyways (not shown) and other known alignment/attachment means (not shown) used for alignment and structural integrity, may be welded from within the medial channel 27 and the presence of the landings 32, 34 and stringers of stairs 33 extending therebetween provides an immediately usable stairway for workers during the installation process.

If plural bodies 20 without preinstalled stringers of stair 33 are stacked within the shaft the stringers of stairs 33 and landings 32, 34 may be installed within the medial channel 27 using techniques known to those in the art.

Various portions and components of apparatus within the scope of the inventions, including for example, structural components, can be formed by one or more various suitable manufacturing processes known to those in the art of towers and shafts. Similarly, various portions and components of apparatus within the scope of the inventions can be made from suitable materials known to those in the art of towers and shafts.

The above description has set out various features, functions, methods and other aspects of my invention. This has been done with regard to the currently preferred embodiments thereof. Time and further development may change the manner in which the various aspects are implemented.

The scope of protection accorded the inventions as defined by the claims is not intended to be limited to the specific sizes, shapes, features or other aspects of the currently preferred embodiments shown and described. The claimed inventions may be implemented or embodied in other forms while still being within the concepts shown, described and claimed herein. Also included are equivalents of the inventions which can be made without departing from the scope of concepts properly protected hereby.

Having thusly described and disclosed a Stackable Tower and Shaft Wall Stair Unit and Method, we file this Utility patent application and pray for issuance of Utility Letters Patent.

The invention claimed is:

1. A stackable tower shaft wall unit for constructing below grade shafts, each stackable tower shaft unit comprising:

a pre-cast concrete body having four spaced apart and structurally interconnected walls, each wall having a first edge, a vertically spaced apart second edge, an interior surface and an exterior surface, the four spaced apart and structurally interconnected walls and defining a medial channel extending from the first edge to the second edge along the interior surface of the four spaced apart and structurally interconnected walls;

a locking and alignment recess defined in the first edge of the precast concrete body at an intersection of two adjacent walls, and wherein the locking and alignment recess has a configuration that prevents translational movement of one precast concrete body relative to a vertically adjacent and second precast concrete body;

a locking and alignment protuberance carried on the second edge of the precast concrete body and which is located at an intersection of two adjacent walls, and which is further located in a diametrically and vertically opposite position relative to the locking and alignment recess and wherein the locking and alignment protuberance is configured to align with and conformably mate with a locking and alignment recess of an adjacent precast concrete body so as to provide a locking configuration that prevents translational movement of one precast concrete body relative to a vertically adjacent precast concrete body; and a below grade shaft is formed by vertically stacking a plurality of precast concrete bodies when an upper precast body is vertically aligned with and vertically stacked upon an adjacent vertically lower precast concrete body, and wherein the upper precast concrete body is horizontally rotated 180° about an axis of the medial channel so that the locking and alignment protuberance carried on the second edge of the upper precast concrete body matingly engages within the locking and alignment recess defined in the first edge of the adjacent, and lower precast concrete body, and wherein the engagement of the locking and alignment protuberance within the locking and alignment recess provides vertical alignment and substantially secure locking engagement to the vertically stacked precast concrete bodies and thereby provides a continuous shaft formed by aligned medial channels.

2. The stackable tower shaft unit for constructing below a grade a shafts of claim 1 further comprising:

a flight of plural stairs within the medial channel of each precast concrete body, the flight of plural stairs having, a first landing located in a coplanar orientation relative to the first edge and a second landing located in a coplanar orientation relative to the second edge, and wherein the flight of plural stairs extends along the interior surface of one wall and further has a plurality of stair risers and stair treads extending from the first landing at the first edge to the second landing at the second edge and wherein the vertical stacking of plural precast concrete bodies causes the flights of plural stairs to be arranged so as to facilitate ascending and descending of the medial channel.

3. A stackable tower shaft unit for constructing below grade shafts, stackable tower shaft unit comprising:

a precast concrete body having four spaced apart and structurally interconnected walls, and wherein each of the four spaced apart and structurally interconnected walls have a first edge and a second edge, and wherein the precast concrete body further defines a medial channel extending from the first edge to the second edge and along an interior surface of each of the four spaced apart and structurally interconnected walls, and wherein the medial channel carries a first landing located in a coplanar orientation relative to the first edge and a second landing located in a coplanar orientation relative to the second edge, and wherein a stairway extends along the interior surface of one wall and further has a plurality of stair risers and stair treads extending from the first landing at the first edge to the second landing at the second edge;

a locking and alignment recess defined in the first edge of the precast concrete body at an intersection of two adjacent walls, and wherein the locking and alignment recess has a configuration that prevents translational movement of one precast concrete body relative to a vertically adjacent and second precast concrete body;

a locking and alignment protuberance carried on the second edge of the precast concrete body and which is located at an intersection of two adjacent walls, and which is further located in a diametrically and vertically opposite position relative to the locking recess, and wherein the locking and alignment protuberance is configured to align with and conformably mate within a locking and alignment recess of an adjacent precast concrete body so as to provide a locking configuration that prevents translational movement of one precast concrete body relative to a vertically adjacent precast concrete body and wherein a below grade shaft is formed by vertically stacking a plurality of precast concrete bodies when an upper precast concrete body is vertically aligned with and vertically stacked upon an adjacent lower precast concrete body, and wherein the upper precast concrete body is horizontally rotated 180° about an axis of the medial channel so that the locking and alignment protuberance carried on the second edge of the upper precast concrete body matingly engages within the locking and alignment recess defined in the first edge of the adjacent, and lower precast concrete body, and wherein the engagement of the locking and alignment protuberance within the locking and alignment recess provides vertical alignment and substantially secure locking engagement to the vertically stacked precast concrete bodies and thereby provides a continuous stairway for ascending and descending the medial channel.

* * * * *